US005242187A

United States Patent [19]

Diard et al.

[11] Patent Number: 5,242,187

[45] Date of Patent: Sep. 7, 1993

[54] SKI HAVING A VARIABLE WIDTH UPPER SURFACE

[75] Inventors: Jean-Luc Diard; Francois Guers, both of Annecy, France

[73] Assignee: Salomon S.A., Annecy, France

[21] Appl. No.: 218,148

[22] Filed: Jul. 13, 1988

[30] Foreign Application Priority Data

Jul. 15, 1987 [FR] France ..... 87 10332

[51] Int. Cl.[5] ..... A63C 5/04

[52] U.S. Cl. ..... 280/609; 280/601

[58] Field of Search ..... 280/600, 601, 602, 608, 280/609, 610, 28; 441/65, 68, 79; 114/274, 283, 288

[56] References Cited

U.S. PATENT DOCUMENTS

| | | | |
|---|---|---|---|
| 3,212,787 | 10/1965 | Werntz | 280/609 |
| 4,261,778 | 4/1981 | Albrigtsen et al. | 280/610 X |
| 4,405,149 | 9/1983 | Piegay | 280/602 |
| 4,433,855 | 2/1984 | Wyke | 280/609 |
| 4,639,009 | 1/1987 | Meatto et al. | 280/602 |
| 4,681,725 | 7/1987 | Maruyama | 280/610 X |
| 4,725,070 | 2/1988 | Maruyama | 280/610 |
| 4,795,184 | 1/1989 | Diard et al. | 280/609 |
| 4,838,572 | 6/1989 | Diard et al. | 280/609 |
| 4,869,523 | 9/1989 | Diard et al. | 280/609 |
| 4,953,884 | 9/1990 | Diard et al. | 280/609 |
| 4,961,592 | 10/1990 | Diard et al. | 280/609 |
| 4,971,349 | 11/1990 | Diard et al. | 280/609 |
| 4,971,350 | 11/1990 | Fagot | 280/609 |

FOREIGN PATENT DOCUMENTS

| | | | |
|---|---|---|---|
| 0985174 | 7/1951 | France . | |
| 1124600 | 10/1956 | France . | |
| 2326953 | 5/1977 | France | 280/601 |
| 2522976 | 9/1983 | France . | |
| 2553669 | 4/1985 | France . | |
| 2559673 | 8/1985 | France | 280/609 |
| 2598929 | 11/1987 | France | 280/609 |
| 2598930 | 11/1987 | France | 280/609 |
| 2598931 | 11/1987 | France | 280/609 |
| 2598932 | 11/1987 | France | 280/609 |
| 0199209 | 10/1938 | Switzerland . | |
| 0408734 | 9/1966 | Switzerland . | |
| 503501 | 4/1971 | Switzerland | 280/609 |
| 0374223 | 6/1932 | United Kingdom . | |

*Primary Examiner*—Eric D. Culbreth

*Attorney, Agent, or Firm*—Sandler Greenblum & Bernstein

[57] ABSTRACT

A ski comprises a longitudinally extending body having a central region interposed between anterior and posterior segments. The body has a lower sliding surface whose width is defined by a pair of opposed lower edges connected to two lateral side surfaces that are inclined relative to the lower sliding surface. An upper surface is connected to the laterally side surfaces and has a width defined by opposed lateral edges which diverge towards the front of the ski in the interior segment of the body, and which are substantially parallel to each other in the posterior segment.

38 Claims, 2 Drawing Sheets

SKI HAVING A VARIABLE WIDTH UPPER SURFACE

BACKGROUND OF THE INVENTION

1. Field of the Invention

The present invention relates to skis utilized in winter sports, and adapted to slide on ice and snow.

2. Related Subject Matter

The subject matter in this patent is related to the commonly assigned U.S. patent application Ser. No. 07/548,204, filed on Jul. 5, 1990, and the following commonly assigned U.S. Pat. Nos. 4,795,184, issued on Jan. 3, 1989; 4,838,572, issued on Jun. 13, 1989; 4,869,523, issued on Sep. 26, 1989; 4,971,349, issued on Nov. 20, 1990; 5,000,475, issued on Mar. 19, 1991; 5,002,300, issued on Mar. 26, 1991; 5,002,301, issued on Mar. 26, 1991; 5,033,765, issued on Jul. 23, 1991.

3. Description of Background and Relevant Information

A ski generally comprises a body having an upper surface, and a lower sliding surface provided with metallic corners along the lower lateral edges thereby defining the width of the sliding surface. The width of a ski is relatively small compared to its length; and the front end of the ski is curved upwardly to form a spatula. Typically, the width of a ski is narrower in the central region than in either the front or rear regions, the width being a maximum at the front of the ski adjacent the spatula. The thickness of the ski generally is greater in the central portion where the binding for the ski is located. Then in either the front or rear portions of the ski.

Conventional skis generally have a composite structure in which different materials are combined in a manner such that the material serves a specialized function taking into account the distribution of mechanical stresses in the ski. A typical composite structure comprises mechanical resistance elements, or reinforcing elements, of a material having a high mechanical resistance to strain, and substantial rigidity so as to resist flexional and torsional stresses produced in a ski during its use. The conventional structure, furthermore, may include filler elements, and sometimes shock absorption elements.

The two principal modern composite structures finding current wide scale application in skis are the so called "sandwich" and "casing" structures. In a typical casing structure, such as described in French Patent No. 985,174, and in FIG. 3 of French Patent No. 1,124,600, the ski comprises an internal core made of cellular material which may be partially hollow, and mechanical resistance elements surrounding the core in the form of layers that constitute a casing for the core.

In a typical sandwich structure, such as described in U.S. Pat. No. 4,405,149, the ski comprises a central core made of a cellular material, which may be partially hollow, reinforced above and below respectively, by an upper resistance layer and a lower resistance layer. It has been observed that a sandwich structure provides a ski that has the best straight line sliding characteristics, i.e., when the ski moves in the longitudinal direction of the ski. On the other hand, the lateral gripping quality of such a ski during banking or turning maneuvers is not optimal. For this reason, skis having a casing structure are preferred in order to optimize skiing on inclines or in executing turns, since a casing structure has superior flexional elasticity and mechanical resistance properties, and a substantial resistance to torsion along the longitudinal axis of the ski. Skis having a casing structure provide optimum lateral gripping qualities during banking or turning maneuvers. On the other hand, the straight line sliding characteristics of such skis are less desirable than skis having a sandwich structure.

As a result, it is customary to select skis on the basis of the use to which the ski will be put. For example, a ski having a sandwich structure is selected for downhill competition, because this structure has superior sliding Characteristics, and a ski having a casing structure is selected for slalom competition because the casing structure has superior ice-gripping qualities.

An object of the present invention is to provide a new and improved ski which produces novel and advantageous technical effects, thereby avoiding the above-described deficiencies of the prior art.

SUMMARY OF THE INVENTION

A ski according to the present invention comprises a longitudinally extending body having a central region interposed between anterior and posterior segments. The anterior segment terminates at a front contact line near the front of the ski and the posterior segment terminates in a rear contact line near the rear of the ski. The body has a lower sliding surface connected by two lateral side surfaces defining a pair of opposed lower edges. The two lateral side surfaces of the body include portions that are inclined relative to the lower surface and are connected to an upper surface having a width defined by two upper edges. These edges diverge towards the front of the ski in the anterior segment of the body, and are substantially parallel with respect to one another in the posterior segment of the body.

In the preferred form of the invention, the upper edges are substantially straight in both the anterior and posterior segments.

The longitudinal variation in width of the upper surface of the ski permits advantageous longitudinal variation in the inclination angle of each lateral side surface of the ski, such angle being the angle between the lower sliding surface and a lateral side. The variation of this inclination angle along the length of the ski modifies the direction of lateral support between the ski and the snow. When the inclination angle of lateral side surface of a zone of the ski is large, i.e., when the side surface is almost perpendicular to the bottom or sliding surface of the ski, this zone fails to significantly penetrate into the snow during turning maneuvers. In such case, the lateral surface tends merely to rub against the snow. Contrary to this, in a zone of the ski where the inclination angle of a lateral side surface is smaller, lateral penetration of the ski into the snow is facilitated; and as a consequence, the friction of the ski against the snow is reduced.

Mechanical reactions of a ski according to the present invention, particularly when it has a casing structure, are improved by longitudinal variation in the width of the upper surface of the ski. When the casing has lateral side surfaces with large inclination angles, i.e., when each side surface is almost perpendicular to the bottom or the other hand, when the lateral surfaces of the casing are more inclined relative to said reference plane, the casing is more flexible and approaches the reaction of the sandwich type structure.

The invention is also directed to a ski in which the body of the ski includes a longitudinally extending core, a resistance layer overlying the core, and laterally disposed strips of visco-elastic material located on each side of the core. The body of the ski is constructed and arranged such that the cross-section of the strips of visco-elastic material changes with length along the ski, thereby conferring to the ski distributed mechanical shock absorption properties which vary along the length of the ski.

The provision of a composite structure having a strip of visco-elastic material located on each side of a central core in the body of a ski, permits a predetermined variation in shock absorption capacity of the ski to be built into the ski by taking into account the volume of visco-elastic material at each longitudinal position of the ski. In zones where an increase in shock absorption capacity is desired, the volume of visco-elastic material can be increased; and, conversely, in zones in which the shock absorption capacity can be decreased, the visco-elastic material would have a reduced volume.

According to the present invention, the inclination angle of the lateral side surfaces of the ski in the rear or posterior segment thereof may be smaller than in the front or anterior segment of the ski. In the median zone and anterior segment of the ski, the inclination angle of the lateral side surfaces is large, which is to say that side surfaces approach perpendicularity with respect to the lower sliding surface of the ski.

The reaction of a ski according to the present invention is particularly advantageous. That is to say, a ski according to the present invention has good resistance during frontward torsion for steering and for negotiating curves, and at the same time effects an easy release of the rear portion of the ski during a turning maneuver. The structure of the present invention also provides a good distribution of pressure under the ski during a turning maneuver. In the beginning of a turn, the user shifts his weight towards the rear to take advantage of the flexibility of the rear portion of the ski. During the actual turning portion of the curve itself, the skier guides the skis by shifting his weight slightly forwardly to take advantage of the rigidity of the front portion of the skis. A ski according to the present invention is thus ideally suited for maneuvers of this type.

According to a particular embodiment of the present invention, the ski comprises a longitudinal core that extends substantially over the length of the body, and a casing surrounding the core for providing mechanical strength. The casing includes an upper resistance layer overlying the core and a lower resistance layer underlying the core. A pair of lateral resistance walls respectively interconnect the layers on opposite lateral edges. Preferably, the lateral resistance walls are parallel to the corresponding lateral side surfaces of the ski.

The longitudinal variation in inclination of the lateral surfaces of the ski, which follow the longitudinal variation in the respective width of the upper and the lower surfaces of the ski along the length of the ski, mirror the longitudinal variation in inclination of the lateral surfaces of the casing. This results in an advantageous variation in the mechanical resistance properties of the casing.

When a strip of visco-elastic material is positioned on each lateral side of the central core, the width and, hence, the volume of visco-elastic material, is limited laterally by the core, on the one hand and by the corresponding lateral wall of the ski, on the other hand. The longitudinal variation in inclination and spacing of the lateral walls of the ski, as well as the longitudinal variation in thickness of the ski, produce a corresponding variation in cross-section of the volumes of visco-elastic material. This variation in cross-section of visco-elastic material confers to the body of the ski mechanical shock absorption properties which are appropriate and which are distributed longitudinally along the ski.

In a preferred embodiment of the invention, the central core has a constant width.

BRIEF DESCRIPTION OF THE DRAWINGS

Non-limiting examples of various embodiments of the present invention are disclosed in accompanying drawings wherein.

DESCRIPTION OF PREFERRED EMBODIMENTS

Figure 3:
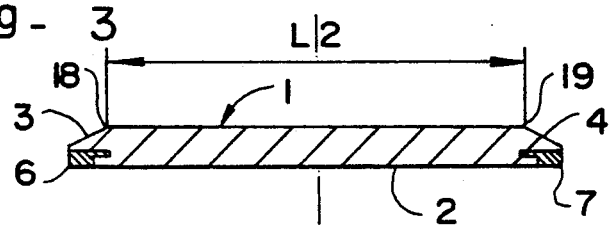
Figure 7:
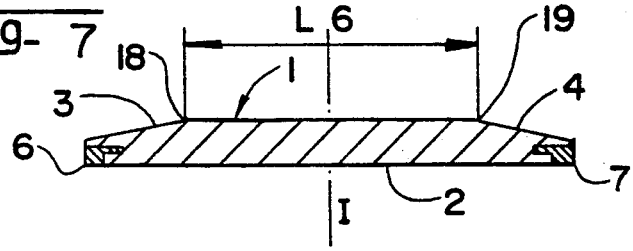

Referring to the drawings, a ski according to the present invention includes a longitudinally extending body having a central region interposed between a posterior segment, and an anterior segment on the free end of which is upwardly curved spatula 5. The body of ,the ski has upper surface 1, lower sliding surface 2, and a two lateral, side surfaces 3 and 4. Lateral side edges 6, 7 of lower surface 2 are preferably provided with metallic corners 60 and 70. The cross-section of the ski in the central region thereof taken along the line D—D is shown of FIG. 5; and at this location, lower surface 2 has a width L7 that is a minimum. The width of the lower surface progressively increases, i.e., increases monotonically, towards the forward and rearward ends of the ski. Thus, the width of surface 2 at cross-section F—F (FIG. 7) near the rear of the ski, and at cross-section B—B (FIG. 3) near the front of the ski exceeds the width of surface 2 in the central region of the ski.

Figure 4:
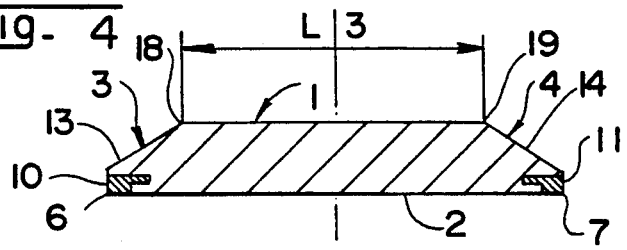

In distinction to the lengthwise variation in width of surface 2, the width of upper surface of the ski 1 varies in a different manner. In the anterior zone of the ski, i.e., the zone located in front of the transverse median plane II—II of the ski, the width of upper surface 1 increases progressively in a continuous manner towards the front of the ski. In the posterior zone of the ski, i.e., the zone positioned at the rear of the transverse median plane II—II, the width of upper surface 1 is substantially constant with length. Thus, the width L6 in cross-section F—F (FIG. 7) adjacent the rear end of the ski is equal to the width L5 in cross-section E—E (FIG. 6) intermediate the central region and the rear end, as well as to the width L4 at cross-section D—D (FIG. 5) adjacent median plane II. The width L3 in cross-section C—C (FIG. 4) intermediate the central region and the front end of the ski is greater than the width L4; the width L2 in cross-section B—B (FIG. 3) near the front of the ski is greater than the width L3; and the width L1 in cross-section S-S adjacent the spatula of the ski is greater than the width L2.

Upper surface 1 is defined by two lateral upper edges 18 and 19. Towards the front of the ski, the edges are defined, respectively, by upper forward segments 181 and 191 which diverge towards the front of the ski. Toward the rear of the ski, the edges are defined, respectively, by upper rearward segments 182 and 192 which are substantially parallel to one another. These characteristics are advantageous because they define the particular properties of the ski of the present invention. Preferably, upper segments 181, 182, 191 and 192 are of a substantially rectilinear shape; so as to facilitate their construction.

The thickness of the ski, or the spacing between lower surface 2 and upper surface 1, varies longitudinally along the ski. Thus, in the cross-sectional views shown in FIGS. 2-7, the thickness is relatively greater in the central region, corresponding to cross-section D—D of FIG. 5, and relatively less in anterior and posterior segments of the ski as shown in the cross-section B—B of FIG. 3 and cross-section F—F of FIG. 7.

Figure 1:
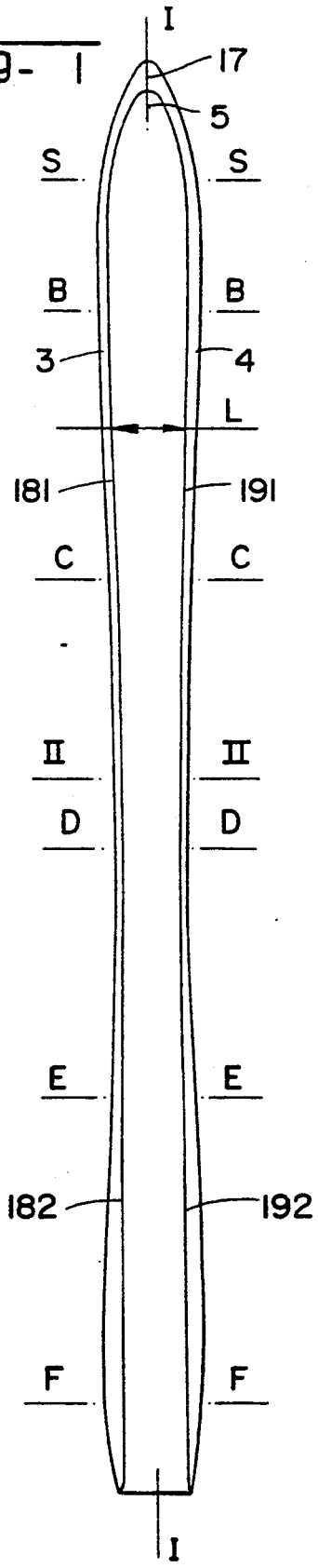
FIG. 1 is a top view of the ski according to the present invention.
Figure 2:
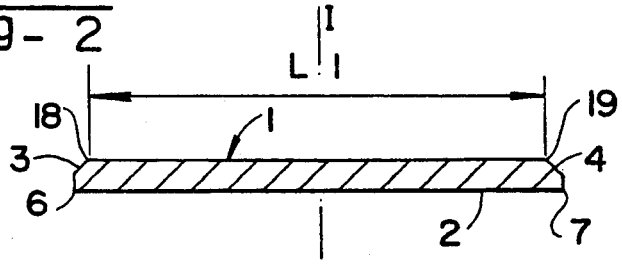
FIGS. 2-7 are transverse cross-sections of the ski of FIG. 1 taken along transverse lines S—S, B—B, C—C, D—D, E—E, and F—F of FIG. 1.
Figure 5:
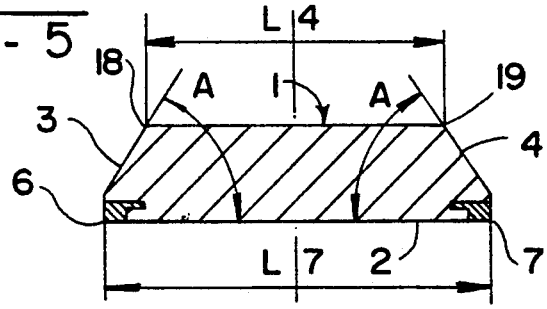
Figure 6:
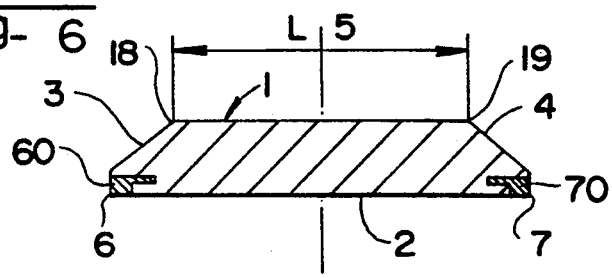

As shown in the drawing, upper surface 1 has a width that varies in a first manner as described above. Lower surface 2, on the other hand, has a width that varies in a second manner. Specifically, the width of lower surface 2 varies longitudinally and is defined by two concave lateral profiles symmetrical about axis I—I as shown in FIG. 1. In order to effect a connection between upper surface 1 and lower surface 2, while still taking into account the longitudinal variation in thickness of the ski, lateral side surfaces 3 and 4 of the ski have a longitudinally variable inclination. As shown in FIG. 5, side surfaces 3 and 4 form, with lower surface 2, an average interior inclination angle less than 90° which is designated by reference character A. Specifically, angle A varies longitudinally along the ski. In the posterior segment of the ski, corresponding to the cross-section F—F, the value of the angle A is less than the value of the angle A in the anterior segment of the ski corresponding to the cross-sections C—C or B—B.

As shown in the drawings, lateral side surfaces 3 and 4 comprise a lower portion or zone, constituted by sides 10 and 11 respectively, which are substantially perpendicular to the lower surface of the ski. Sides 10 and 11 preferably have a height of several millimeters, and correspond to the positioning of the corners. Side surfaces 3 and 4 also comprise an upper zone constituted by surfaces 13 and 14 respectively, which are positioned at inclination angle A relative the sliding surface 2.

Preferably, the upper surface of the ski is narrower than the lower surface of the ski at each longitudinal location of the ski. In the vicinity of the central portion of the ski, i.e., at cross-section D-D, the width of upper surface 1 is only slightly less than the width of lower surface 2 of the ski. The term "in the vicinity of" is intended to mean within a region close to central axis II—II shown in FIG. 1. As a result, average inclination angle A has a range in this region of about 60°-90°. The range is substantially the same in the anterior segment of the ski. On the other hand, in the posterior segment of the ski, for example at cross-section F—F, the width L6 of the upper surface 1 of the ski is considerably less than the width of the lower surface 2 of the ski. As a result, the average inclination angle A in the posterior segment of the ski is less than 45°. These specifications provide a particularly noticeable effect on the shape of a ski and confer on the ski properties which are well adapted for its use.

Figure 8:
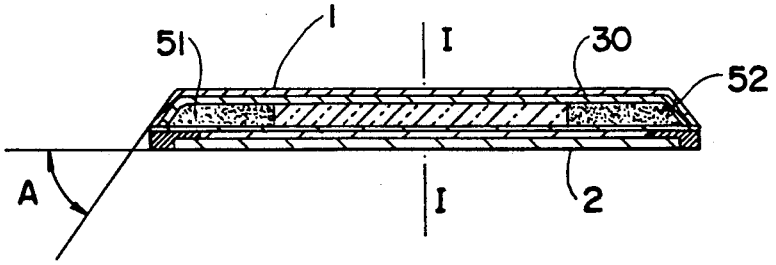
FIG. 8 is a transverse cross-section in the zone B—B of FIG. 1 of a ski having a casing structure according to the present invention.
Figure 9:
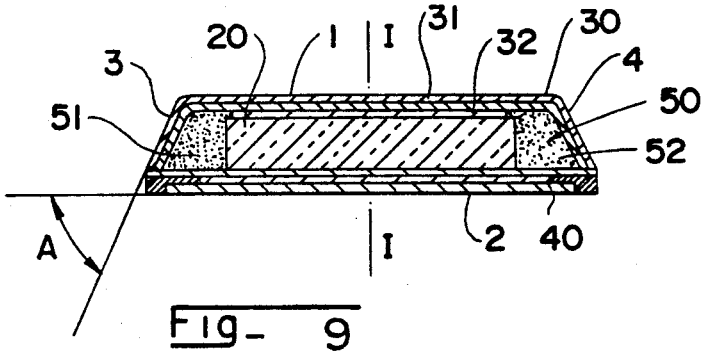
FIG. 9 is a transverse cross-section in the zone D—D of FIG. 1 for ski having a casing structure according to the present invention.
Figure 10:
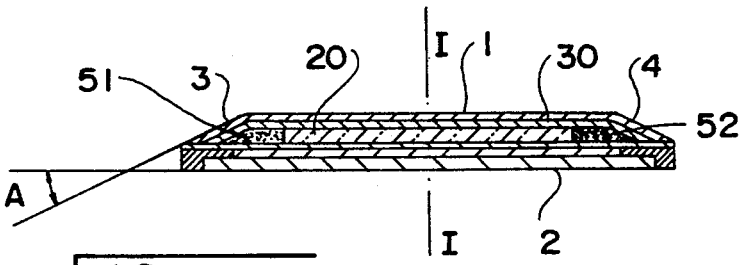
FIG. 10 is a transverse cross-section in the zone S—S of FIG. 1 for a ski having a casing structure according to the present invention.
Figure 11:
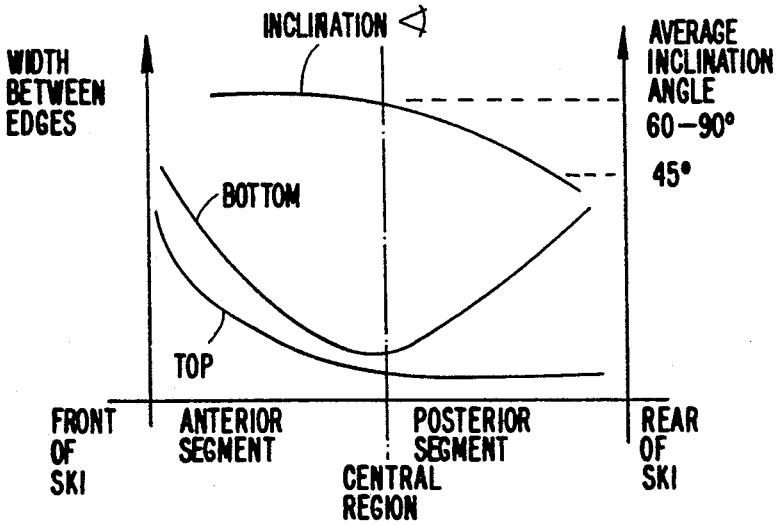
FIG. 11 is a graph that illustrates the longitudinal Variation of the widths of the top and bottom surfaces of a ski according to the present invention, and the longitudinal variation in the average inclination angle of the sides of the ski.

FIGS. 8-10 shown in detail transverse cross-sections of a ski having a casing structure into which visco-elastic shock absorption elements are incorporated. In such a structure, the ski has a mechanical resistance casing construction that is symmetrical with respect to the longitudinal vertical median axis I-I of the ski. FIG. 9 shows a transverse cross-section of the ski adjacent zone E—E. As shown in FIG. 9, the body of the ski comprises four principle portions: core 20 having a substantially rectangular cross-section, shell 30, a lower element 40, and filling layer 50.

Core 20 may be made of different materials, such as wood or synthetic foam, or other cellular structures such as aluminum honeycomb. The core, likewise, may be partially hollow, constituted, for example, of metallic or plastic tubes.

Shell 30, in the embodiment shown, is a composite shell comprising exterior visible layer 31, made of thermoplastic material, for example, and reinforcement casing layer 32, constituted of a material having a high mechanical resistance, such as laminated wood, plastic, or glass fibers. Aluminum alloy is another example of suitable material. Exterior layer 31 may be made of a thermoplastic material such as acrylonitrile-butadiene-styrene, generally designated as ABS, or a polyamide, or a polycarbonate.

Reinforcement layer 32 may be formed from one or more sheets of glass fabric, carbon fabric or other material, these layers preferably being pre-impregnated with thermoplastic resins such as a polyetherimide, or a thermohardening resin such as an epoxyde or a polyurethane. The glass fabric or the like is preferably of the unidirectional type, and comprises, for example, 90% of the fibers oriented in the direction of the length of the ski, and 10% in the transverse direction.

Interior filling layer 50, which assures appropriate linking of core 20 to reinforcement layer 32, is constituted by visco-elastic material. Suitable visco-elastic material can be selected from thermoplastic materials, synthetic resins, silicon elastomers, rubbers, butyl polychloroprenes, acrylic nitriles, ethylenes, propylenes, and ionomers. As is well known, a visco-elastic material has behavioral properties intermediate those of solids and liquids. In a liquid, strain is directly proportional to the velocity of deformation; in a solid, the strain is directly proportional to the deformation; but in a visco-elastic material, the strain is a function of the velocity of deformation and of the deformation itself. As a consequence, visco-elastic material at least partially absorbs shock energy and deformational forces. In the present application, the strips of visco-elastic material can be tightly affixed to the mechanical resistance element by a bonding process.

Reinforcement layer 32 has an inverted U-shape cross-section and is attached to lower element 40 which forms the lower resistance layer. The assembly constitutes a closed casing structure, surrounding core 20.

In the embodiment shown, core 20 has a substantially constant width over the entire length of the ski. Its width is substantially equal to the minimum width of upper surface 1 of the ski, i.e., to the width L4. Filling layer 50, of visco-elastic material, is constituted by first laterally disposed left strip 51, and second laterally disposed right strip 52. Strips 51 and 52 may be connected by an upper portion in the form of a layer of visco-elastic material, and/or by a lower portion which is likewise in the form of a layer of visco-elastic material.

As shown in FIGS. 9 and 10, particularly, the longitudinal variations in spacing, and in the inclination of lateral surfaces 3 and 4 of the ski, result in a longitudinal variation in the shape and in the cross-section of lateral strips 51 and 52 of visco-elastic material. For example, the cross-section of visco-elastic material in FIG. 10 is greater than the cross-section in FIG. 9. In particular, the cross-section of visco-elastic volume is very reduced in FIG. 8.

As further shown in FIG. 8, the inclination of the lateral side surfaces approach being perpendicular to lower surface 2 of the ski. In this zone of the ski, which is part of the anterior region, the ski performs as if it had a casing structure producing a high resistance to torsion. On the contrary, in zone E—E shown in FIG. 10, which is part of the posterior region, the casing is likewise flattened, but the lateral side surfaces are more inclined than in the anterior region. As a result, in the posterior region of the ski, the body of the ski performs as if it had a sandwich structure.

Lateral surfaces 3 and 4 are shown in the drawings as being symmetrical with respect to vertical longitudinal median plane I—I of the ski. However, the invention also includes asymmetrical lateral side surfaces for producing differential reactions of a ski. Asymmetry of the lateral side surfaces of a ski may be achieved by a transverse eccentricity with respect to median plane I—I, and/or by different inclinations.

Without going beyond the scope of the present invention, the lateral side surfaces need not be planar as shown in the drawing. Rather, such surfaces could have a curvilinear transverse profile. Likewise, the upper surface 1 of the ski can have a slightly convex or concave profile.

Although the invention as been described with reference to particular means, materials and embodiments, it is to be understood that the invention is not limited to particulars disclosed and extends to all equivalents within the scope of the claims that follow.

We claim:

1. A ski for use on snow comprising:

a) a longitudinally extending body having a central region interposed between an anterior segment, terminating at a front contact line near the front of the ski, and a posterior segment, terminating in a rear contact line near the rear of the ski;

b) said body having a lower sliding surface extending between the front and rear contact lines and connected to two lateral side surfaces defining a pair of opposed lower edges;

c) the two lateral side surfaces of the body at least having respective portions that are inclined relative to the lower surface, the respective inclined portions being connected to an upper surface; and d) said upper surface, between the front and rear contact lines, having a width defined by two upper edges which diverge towards the front of the ski in said anterior segment of the body, and which are substantially parallel with respect to each other in said posterior segment.

2. A ski according to claim 1 wherein the width of the upper surface of the ski at each transverse cross-section of the body is less than the width of the lower surface of the ski.

3. A ski according to claim 1 wherein the width of the upper surface is only slightly less than the width of the lower surface of the ski in the vicinity of a central region of the ski.

4. A ski according to claim 1 wherein the upper edges are substantially straight.

5. A ski according to claim 4 wherein the body of the ski includes:

a) a longitudinally extending core;

b) a resistance layer overlying said core;

c) laterally disposed strips of visco-elastic material positioned on each side of the core, each strip being laterally limited by the core, and by the lateral side surfaces of the ski;

d) said strips being constructed and arranged such that the cross-section of the strips changes with length along the ski thereby conferring distributed mechanical shock absorption properties to the body of the ski which change with length along the ski.

6. A ski according to claim 5 wherein the core has a substantially constant width.

7. A ski according to claim 4 wherein the width of the upper surface of the ski at each transverse cross-section of the body is less than the width of the lower surface of the ski.

8. A ski according to claim 4 wherein the width of the upper surface is only slightly narrower than the width of the lower surface of the ski adjacent to a central region of the ski.

9. A ski according to claim 4 wherein the opposed lower edges of said lower sliding surface of the ski defines a concave lateral profile.

10. A ski according to claim 4 wherein the average inclination angle of the inclined portions of the lateral side surfaces of the ski relative to the sliding surface of the ski is in the range of about 60°-90° in the anterior and central segments of the ski.

11. A ski according to claim 10 wherein the average inclination angle of the inclined portions of the lateral side surfaces of the ski is less than about 45° in the posterior segment of the ski.

12. A ski for use on snow comprising:

a) a longitudinally extending body having a central region interposed between an anterior segment at the front of the ski and a posterior segment at the rear of the ski;

b) said body having a lower sliding surface connected to two lateral side surfaces defining a pair of opposed lower edges;

c) the two lateral side surfaces of the body at least having respective portions that are inclined relative to the lower surface, the respective inclined portions being connected to an upper surface;

d) said upper surface having a width defined by two upper edges which diverge towards the front of the ski in said anterior segment of the body, and which are substantially parallel with respect to each other in said posterior segment; and wherein the body of the ski includes:

(1) a longitudinal core that extends substantially over the length of the body; and (b 2) a casing surrounding the core for providing mechanical strength;

(3) said casing including an upper resistance layer overlying said core and a lower resistance layer underlying said core, and a pair of lateral resistance walls respectively interconnecting said layers on opposite lateral edges, the lateral resistance walls being parallel to the corresponding inclined portions of the lateral side surfaces of the ski.

13. A ski according to claim 12 wherein the width of the upper surface of the ski at each transverse cross-section of the body is less than the width of the lower surface of the ski.

14. A ski according to claim 12 wherein the width of the upper surface is only slightly less than the width of the lower surface of the ski in the vicinity of a central region of the ski.

15. A ski according to claim 12 wherein the opposed lower edges of said lower sliding surface of the ski defines a concave lateral profile.

16. A ski according to claim 12 wherein the average inclination angle of the inclined portions of the lateral side surfaces of the ski relative to the sliding surface of the ski is in the range of about 60°–90° in an anterior and central segments of the ski.

17. A ski according to claim 16 wherein the average inclination angle of the inclined portions of the lateral side surfaces of the ski is less than about 45° in the posterior segment of the ski.

18. A ski for use on snow comprising:

a) a longitudinally extending body having a central region interposed between an anterior segment at the front of the ski and a posterior segment at the rear of the ski;

b) said body having a lower sliding surface connected to two lateral side surfaces defining a pair of opposed lower edges;

c) the two lateral side surfaces of the body at least having respective portions that are inclined relative to the lower surface, the respective inclined portions being connected to an upper surface; and d) said upper surface having a width defined by two upper edges which diverge towards the front of the ski in said anterior segment of the body, and which are substantially parallel with respect to each other in said posterior segment;

e) wherein the upper edges are substantially straight, and wherein the body of the ski includes:

(1) a longitudinal core that extends substantially over the length of the body; and (2) a casing surrounding the core for providing mechanical strength, said casing including an upper resistance layer overlying said core, and a lower resistance layer underlying said core, and a pair of lateral resistance walls respectively interconnecting said layers on opposite lateral edges, the lateral resistance walls being parallel to the corresponding inclined portions of the lateral side surfaces of the ski.

19. A ski according to claim 18 wherein the body of the ski includes:

a) a longitudinally extending core;

b) a resistance layer overlying said core;

c) laterally disposed strips of visco-elastic material positioned on each side of the core, each strip being laterally limited by the core, and by the lateral side surfaces of the ski;

d) said strips being constructed and arranged such that the cross-section of the strips changes with length along the ski thereby conferring distributed mechanical shock absorption properties to the body of the ski which change with length along the ski.

20. A ski according to claim 19 wherein the core has a substantially constant width.

21. A ski according to claim 18 wherein the body of the ski includes:

a) laterally disposed strips of visco-elastic material positioned one each side of the core, each strip being laterally limited by the core, and by the lateral side surfaces of the ski;

b) said strips being constructed and arranged such that the cross-section of the strips changes with length along the ski thereby conferring distributed mechanical shock absorption properties to the body of the ski which change with length along the ski.

22. A ski according to claim 21 wherein the core has a substantially constant width.

23. A ski according to claim 18 wherein the width of the upper surface of the ski at each transverse cross-section of the body is less than the width of the lower surface of the ski.

24. A ski according to claim 18 wherein the width of the upper surface is only slightly less than the width of the lower surface of the ski in the vicinity of a central region of the ski.

25. A ski according to claim 18 wherein the opposed lower edges of said lower sliding surface of the ski defines a concave lateral profile.

26. A ski according to claim 18 wherein the average inclination angle of the inclined portions of the lateral side surfaces of the ski relative to the sliding surface of the ski is in the range of about 60°–90° in the anterior and central segments of the ski.

27. A ski according to claim 26 wherein the average inclination angle of the inclined portions of the lateral side surfaces of the ski is less than about 45° in the posterior segment of the ski.

28. A ski for use on snow comprising:

a) a longitudinally extending body having a central region interposed between an anterior segment at the front of the ski and a posterior segment at the rear of the ski;

b) said body having a lower sliding surface connected to two lateral side surfaces defining a pair of opposed lower edges;

c) the two lateral side surfaces of the body at least having respective portions that are inclined relative to the lower surface, the respective inclined portions being connected to an upper surface; and d) said upper surface having a width defined by two upper edges which diverge towards the front of the ski in said anterior segment of the body, and which are substantially parallel with respect to each other in said posterior segment; and wherein the body of the ski includes:

(1) a longitudinally extending core;

(2) a resistance layer overlying said core;

(3) laterally disposed strips of visco-elastic material positioned on each side of the core, each strip being laterally limited by the core, and by the lateral side surfaces of the ski;

(4) said strips being constructed and arranged such that the cross-section of the strips changes with length along the ski thereby conferring distributed mechanical shock absorption properties to the body of the ski which change with length along the ski.

29. A ski according to claim 28 wherein the core has a substantially constant width.

30. A ski according to claim 28 wherein the width of the upper surface of the ski at each transverse cross-section of the body is less than the width of the lower surface of the ski.

31. A ski according to claim 28 wherein the width of the upper surface is only slightly less than the width of the lower surface of the ski in the vicinity of a central region of the ski.

32. A ski according to claim 28 wherein the opposed lower edges of said lower sliding surface of the ski defines a concave lateral profile.

33. A ski according to claim 28 wherein the average inclination angle of the inclined portions of the lateral side surfaces of the ski relative to the sliding surface of the ski is in the range of about 60°-90° in the anterior and central segments of the ski.

34. A ski for use on snow comprising:

a) a longitudinally extending body having a central region interposed between an anterior segment, terminating at a front contact line near the front of the ski, and a posterior segment, terminating in a rear contact line near the rear of the ski;

b) said body having a lower sliding surface extending between the front and rear contact lines and connected to two lateral side surfaces defining a pair of opposed lower edges;

c) the two lateral side surfaces of the body at least having respective portions that are inclined relative to the lower surface, the respective inclined portions being connected to an upper surface; and d) said upper surface, between the front and rear contact lines, having a width defined by two upper edges which diverge towards the front of the ski in said anterior segment of the body, and which are substantially parallel with respect to each other in said posterior segment;

wherein the opposed lower edges of said lower sliding surface of the ski defines a concave lateral profile.

35. A ski for use on snow comprising:

a) a longitudinally extending body having a central region interposed between an anterior segment, terminating at a front contact line near the front of the ski, and a posterior segment, terminating in a rear contact line near the rear of the ski;

b) said body having a lower sliding surface extending between the front and rear contact lines and connected to two lateral side surfaces defining a pair of opposed lower edges;

c) the two lateral side surfaces of the body at least having respective portions that are inclined relative to the lower surface, the respective inclined portions being connected to an upper surface; and d) said upper surface, between the front and rear contact lines, having a width defined by two upper edges which diverge towards the front of the ski in said anterior segment of the body, and which are substantially parallel with respect to each other in said posterior segment;

wherein the average inclination angle of the inclined portions of the lateral side surfaces of the ski relative to the sliding surface of the ski is in the range of about 60°-90° in the anterior and central segments of the ski.

36. A ski according to claim 35 wherein the average inclination angle of the inclined portions of the lateral side surfaces of the ski is less than about 45° in the posterior segment of the ski.

37. A ski for use on snow comprising:

a) a longitudinally extending body having a central region interposed between an anterior segment, terminating at a front contact line near the front of the ski, and a posterior segment, terminating in a rear contact line near the rear of the ski;

b) said body having a lower sliding surface extending between the front and rear contact lines and connected to two lateral side surfaces defining a pair of opposed lower edges;

c) the two lateral side surfaces of the body at least having respective portions that are inclined relative to the lower surface, the respective inclined portions being connected to an upper surface; and d) said upper surface, between the front and rear contact lines, having a width defined by two upper edges which diverge towards the front of the ski in said anterior segment of the body, and which are substantially parallel with respect to each other in said posterior segment;

wherein the inclination angle of the inclined portions of the lateral side surfaces, measured between the lower sliding surface and an inclined portion of a side surface, varies monotonically in the longitudinal direction.

38. A ski according to claim 37 wherein the variation in the inclination angle is monotonically increasing from rear to front of the ski.

* * * * *